United States Patent [19]

Holloway

[11] Patent Number: 4,520,592

[45] Date of Patent: Jun. 4, 1985

[54] AUTOMATIC GATE OPENER

[76] Inventor: Falis E. Holloway, P.O. Box 911, Lancaster, Tex. 75146

[21] Appl. No.: 529,039

[22] Filed: Sep. 2, 1983

Related U.S. Application Data

[63] Continuation-in-part of Ser. No. 250,543, Apr. 3, 1981.

[51] Int. Cl.[3] ..... E05F 11/00

[52] U.S. Cl. ..... 49/358; 49/396; 49/25

[58] Field of Search ..... 49/358, 396, 264, 25

[56] References Cited

U.S. PATENT DOCUMENTS

| | | | |
|---|---|---|---|
| 1,631,416 | 6/1927 | Howard | 49/358 |
| 1,694,431 | 12/1928 | Russell et al. | 49/358 |
| 2,827,284 | 3/1958 | Bunzl | 49/264 X |
| 3,606,699 | 9/1971 | Robinson, Jr. | 49/264 X |
| 3,988,860 | 11/1976 | Nevarez | 49/396 |
| 4,231,190 | 11/1980 | Tieben | 49/25 |

FOREIGN PATENT DOCUMENTS

| | | | |
|---|---|---|---|
| 5140/26 | 12/1926 | Australia | 49/358 |
| 785122 | 10/1957 | United Kingdom | 49/358 |

*Primary Examiner*—Kenneth Downey

*Attorney, Agent, or Firm*—Richards, Harris, Medlock & Andrews

[57] ABSTRACT

A gate opener (14) is disclosed for attachment to a pre-existing gate (10) mounted for pivotal motion to a post (12). The gate opener includes a controller (30) for activation by an operator from a remote location, such as a vehicle, to transmit a signal of predetermined frequency to a receiver (32) mounted by the gate. The receiver (32) activates a relay to initiate operation of an electric motor (34) to open or close the gate. The rotating motion of the motor shaft is transferred through a set of pulleys (37, 39), a belt (43), gears (48, 54) and a chain (58) to a wheel (38) in contact with the ground. A gate opener (100) forms a second embodiment of the invention. The gate opener (100) is supported by a parallel arm hinge assembly (104) so that substantially the entire weight of the gate opener (100) is supported on the ground (40) through the ground wheel (132) to provide traction to the ground wheel. An open limiter switch (136) and a closed limiter switch (138) cooperate with adjustable contacts (140, 142) to deactivate the motor upon movement of the gate (10) into the opened or closed positions to permit the motor (116) and ground wheel (132) to continue rotation until the gate is either opened or closed.

16 Claims, 6 Drawing Figures

AUTOMATIC GATE OPENER

CROSS-REFERENCE TO RELATED APPLICATIONS

This application is a continuation-in-part of U.S. patent application Ser. No. 250,543, filed Apr. 3, 1981.

TECHNICAL FIELD

This invention relates to barriers for openings, and in particular to a gate for use in a fence or similar structure.

BACKGROUND ART

Devices such as disclosed in U.S. Pat. No. 3,988,860, issued Nov. 2, 1976 to Nevarez provide for the opening of a swinging gate assembly. In the device disclosed in this patent, a swinging gate assembly is hingably mounted to a vertical end post. An electric motor is mounted on the opposite end on the gate and a horizontal drive shaft extends to a first pulley member. A second pulley member beneath the first pulley member is connected thereto with a pulley belt. The second pulley member is connected to a wheel member which rotates and moves along the ground to swing the gate assembly open or closed. The motor is operated by a switch or remote control means.

The device disclosed in this patent requires a person approaching the gate in a vehicle to stop the vehicle, exit therefrom and activate the gate opening mechanism. This provides no substantial advantage over the conventional manual opening of the gate.

SUMMARY OF THE INVENTION

In accordance with the present invention, a gate opener for use on a gate mounted to a structure for pivotal motion about a generally vertical axis is provided. The gate opener includes a motor mounted on the gate for rotating a shaft. A conductor provides power to the motor to rotate the shaft. A wheel is rotatably mounted on the gate and in contact with a stationary surface. A transmission interconnects the motor shaft and the wheel for transmitting rotation from the shaft to the wheel. A controller is provided for transmitting a signal having a predetermined frequency. A receiver is also provided for activating the motor in response to reception of the signal of predetermined frequency to selectively open and close the gate.

In accordance with another aspect of the present invention, a gate opener for use on a gate mounted to a structure for pivotal motion about a generally vertical axis is provided. The gate opener includes an electric motor mounted to the gate and having a generally horizontally disposed shaft. A conductor extends from a power source to the electric motor for rotating the shaft. A first gear having a plurality of teeth formed about the outer periphery thereof is mounted for rotation with the shaft of the electric motor. A frame is mounted to the gate adjacent the ground. At least one wheel is mounted on an axle to the frame for rotation and is in contact with the ground along a portion of its outer periphery. A second gear having a plurality of teeth formed about the outer periphery thereof is mounted for rotation with the wheel. A chain interconnects the first and second gears for joint rotation thereof. A controller is provided for transmitting a signal at a predetermined frequency at a position remote from the gate. A receiver is mounted adjacent the gate for receiving the signal of predetermined frequency from the controller and activating the electric motor to rotate a predetermined number of revolutions to move the gate between open and closed positions.

In accordance with yet another aspect of the present invention, a gate opener for use on a gate mounted to a structure for pivotal motion about a generally vertical axis is provided with a mounting bracket pivotally mounted on the gate through a parallel arm hinge. The gate opener is attached to the gate through the mounting bracket with the weight of the gate opener being supported on the ground through a ground wheel. The parallel hinge permits the ground wheel contacting the ground and the remainder of the gate opener to move vertically in response to variation in the ground level. In addition, open and closed limiter switches are provided. Each limiter switch cooperates with a contact for sensing movement of the gate into an open or closed position. Controlling operation of the gate opener through the limiter switches insures that the gate opener will fully close or open the gate despite slippage of the ground wheel during opening or closing of the gate.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
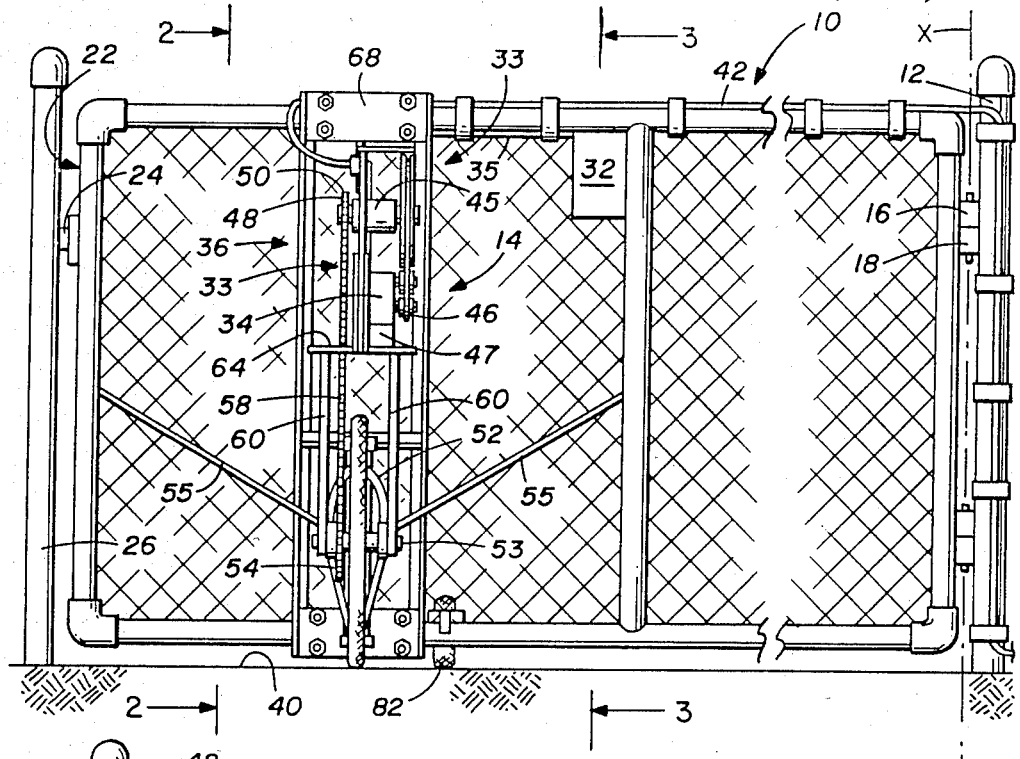
FIG. 1 is a front view of a gate having the gate opener of the present invention mounted thereon.

Referring now to the drawings, wherein like references characters designate like or corresponding parts throughout several views, FIG. 1 illustrates a gate 10 mounted for pivotal motion on post 12 and having a gate opener 14 forming the present invention mounted thereon.

The gate 10 may be of any common type. In FIG. 1, the gate 10 is mounted for pivotal motion about a generally vertical axis X—X. The hinge members 16 of the gate 10 are pivotally mounted to hinge members 18 of post 12. The mounting may be by ball bearing hinges or other suitable hinges. The free swinging end 22 of gate 10 may be provided with a common latch 24 to secure the gate 10 in a closed position to the post 26.

The gate opener 14 is provided for automatic opening or closing of the gate 10 from a remote position. The gate opener includes generally a controller 30 for transmitting the opening signal, a receiver 32 for receiving the signal and an opener unit 33 with reversible motor 34 for rotating a shaft in response to the reception of the signal by the receiver. Also included in opener unit 33 are a transmission 36 for transmitting the rotational motion from the motor shaft to wheel 38 contacting ground 40 for rotation to open and close the gate. A conductor 42 is provided which extends from an external power source to provide power to the motor 34. The receiver 32 may be mounted remotely from opener unit 33 as shown. A signal cable 35 would extend from the receiver to the opener unit 33. However, the receiver 32 could, if desired, be mounted on the opener unit 33.

In operation, the controller 30 may be activated by an operator to generate an electromagnetic signal having a predetermined frequency. The predetermined frequency in the controller 30 for each gate opener 14 sold will be a unique frequency so that a controller from one unit will not activate the gate opener in a separate unit. The controller 30 has a limited range, but will transmit the signal from inside an automobile, truck or other vehicle so that the operator need not leave his vehicle to open or close the gate.

The receiver 32 is designed to be responsive to the signal of predetermined frequency for activating a relay within the receiver. The relay closes a switch associated with electric motor 34 and conductor 42 to start rotation of the drive shaft 46 of the motor. The motor 34 is associated with a sensing device 47. The sensing device 47 permits the drive shaft 46 to rotate a preselected number of rotations in a first direction and then stops motor 34. The device 47 permits shaft 46 to rotate in the opposite direction the same number of rotations during the next activation of motor 34. Sensing device 47 acts to reverse the direction of rotation of the drive shaft 46 upon each activation to move the gate between the open and closed positions. Such a sensing device 47 in the form of a worm gear, and a controller 30, receiver 32 and motor 34 may be purchased from Sears Roebuck and Co., of Chicago, Ill. as Model 139655000.

As shaft 46 is rotated, a first pulley 37 secured therealong is also rotated. Pulleys 39 and 41 are rotated by pulley 37 through belt 43. Pulley 39 is mounted for rotation by housing 45. Pulley 41 is urged outwardly by a spring (not shown) for tensioning the belt. If the gate opener 14 ever fails for any reason, lever 49 may be employed to loosen the belt and free the gate for manual opening and closing. A gear 48 is mounted for rotation with pulley 39 and has a plurality of teeth 50 distributed about the outer periphery thereof. A frame 52 is pivotally mounted to the gate 10 near the ground 40. Frame 52 is pivotal about a vertical axis Y—Y. The frame 52 may be locked in a predetermined pivotal relation to the gate by a threaded screw 51 or stabilizing bars 55 secured between the gate and frame 52. The bars 55 may be replaced with chains.

Wheel 38 is rotatably mounted on frame 52 by axle 53 and is in contact with the ground 40 along a portion of its outer periphery. A second gear 54 is mounted along axle 53 for rotation with wheel 38. The gear 54 is vertically aligned with the first gear 48 and also has a plurality of gear teeth 56 formed about the outer periphery thereof. A common chain 58 engages the teeth 50 and 56 of the gears 48 and 54 so that rotation of gear 48 rotates gear 54.

Rotation of gear 54 rotates the wheel 38. The axle 53 may be mounted on frame 52 in a manner to permit some vertical movement so that some portion of the weight of gate 10 and opener 14 is supported on wheel 38. The supported weight is sufficient to prevent slipping of the wheel 38 as the wheel is rotated so that the gate rotates about the axis X—X in the direction of rotation of the wheel.

Figure 2:
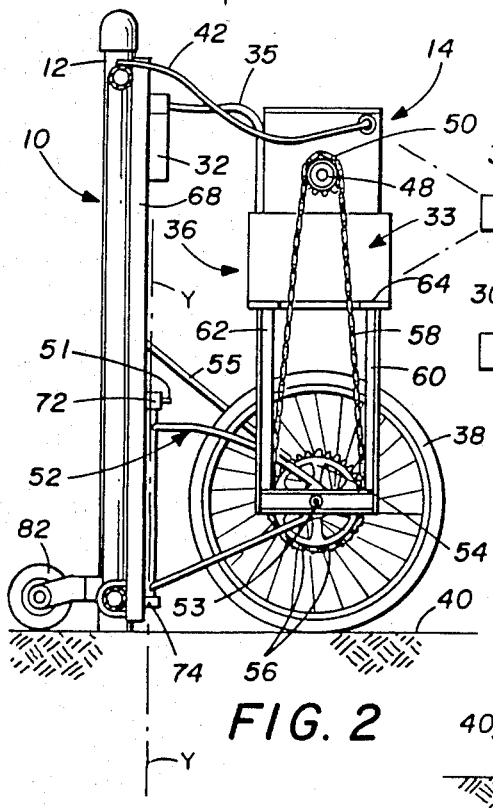
FIG. 2 is a side view of the gate and gate opener illustrated in FIG. 1.
Figure 3:
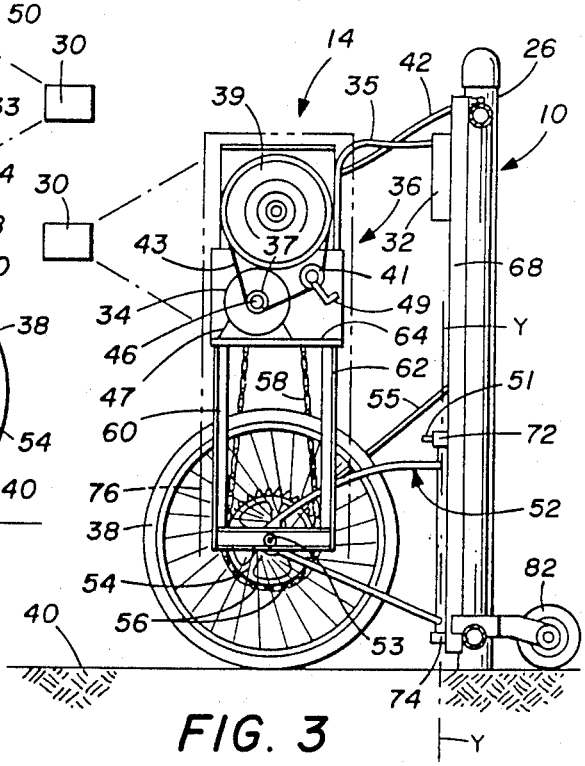
FIG. 3 is the opposite side view of the gate and gate opener forming the present invention.

With reference to FIG. 2, it can be seen that the first gear 48 lies directly above the second gear 54. The motor 34 and associated mechanisms are supported on the frame 52 by braces 60 and 62 and main support 64. The frame 52 is supported for pivotal motion by bracket 68 mounted to the gate 10 through roller bearings 72 and 74. If desired, the major components of gate opener 14 may be protected from the elements by a cover 76 mounted to the gate as illustrated in phantom line in FIG. 3. The cover 76 may be designed to permit the signal from controller 30 to be received by the receiver 32 if the receiver is mounted on opener unit 33.

In the preferred embodiment, the gate 10 will be normally retained in the closed position as shown by FIG. 1. Upon activation of a controller 30 by the operator, either standing before the gate or in a vehicle adjacent the gate, the receiver 32 activates the motor 34 to rotate the wheel 38 to open the gate. The sensing device 47 permits activation of the motor 34 for the predetermined number of revolutions of the shaft 46 sufficient to move the gate 10 to the fully open position. At that point, the sensing device 47 deactivates the relay to stop motor 34. After the operator and/or vehicle have passed through gate 10, the controller 30 is again activated so that the receiver 32 activates a relay to reverse the rotation of motor 34 the same number of revolutions to close the gate.

A second wheel 82 may be mounted on the opposite side of gate 10 from the wheel 38. This will prevent twisting of the fence along its length as wheel 38 is rotated to pivot the gate.

Figure 4:
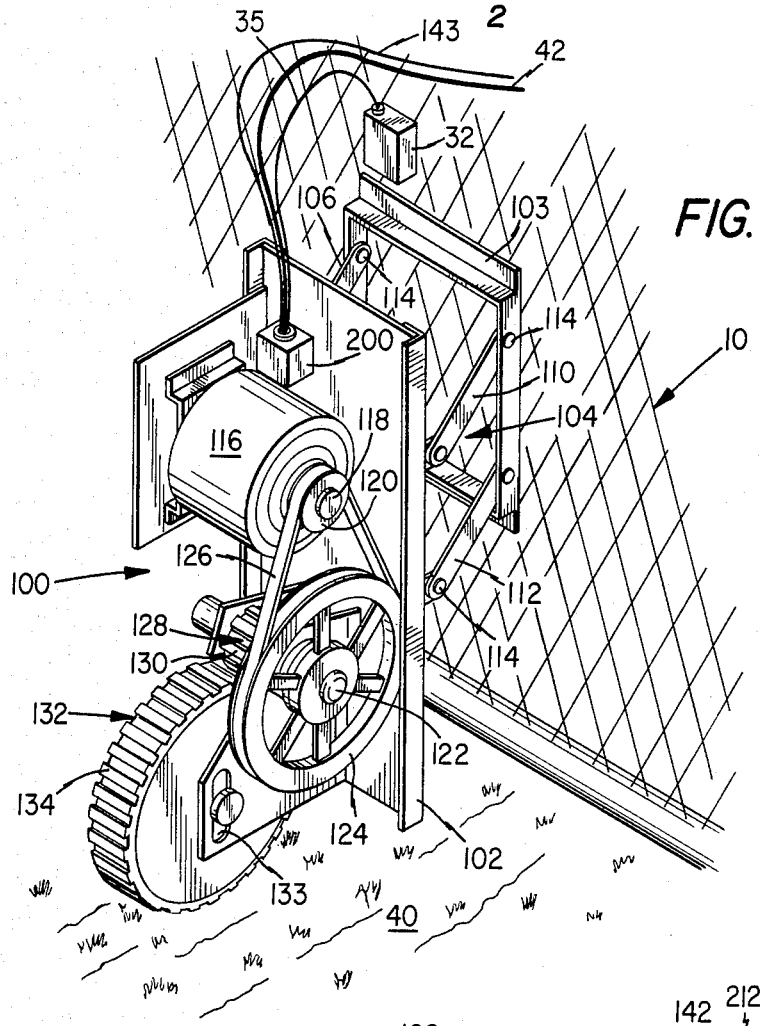
FIG. 4 is a perspective view of a gate opener forming a second embodiment of the present invention.
Figure 5:
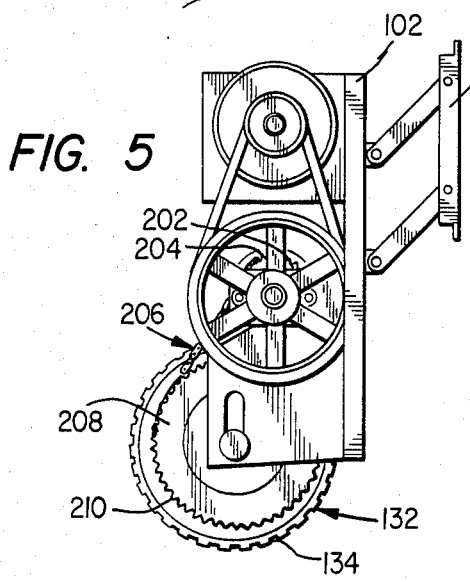
FIG. 5 is a side view of the gate opener forming the second embodiment of the present invention illustrating the parallel arm hinge.
Figure 6:
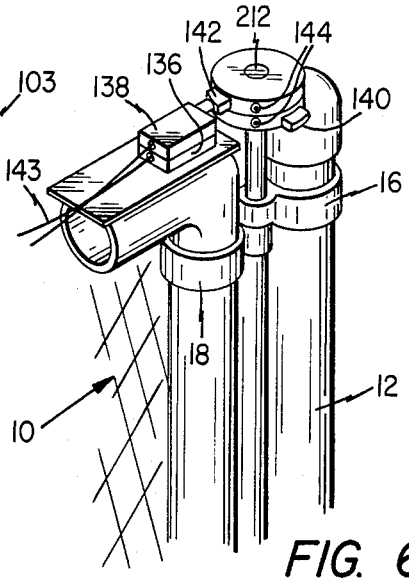
FIG. 6 is a top view of a portion of the gate on which the gate opener forming the second embodiment of the present invention is mounted illustrating the open and closed limiter switches and contacts.

A gate opener 100, illustrated in FIGS. 4–6, forms a second embodiment of the present invention. The gate opener 100 is again mounted on a gate 10 for opening and closing the gate in response to a signal transmitted by a controller 30 to a receiver 32. The receiver 32 may again be mounted on the gate opener 100 or remote therefrom and connected to gate opener 100 through signal cable 35 as desired. A conductor 42 can also be used to provide electrical power to the gate opener 100.

The gate opener includes a mounting bracket 102 supported on the gate through a parallel arm hinge assembly 104. The parallel arm hinge assembly 104 includes four arms 106, 108 (not shown), 110 and 112 and a plate 103. Plate 103 is secured directly to gate 10. Each arm is hinged at one end to the plate 103 through pivotable structure such as a hinge pins 114 and hinged at its opposite end to the mounting bracket 102, again through pivotable structure such as hinge pins 114. The arms 106–112 are all pivotally secured to the gate 10 and mounting bracket for pivotal motion about horizontal axes. The arms 106–112 are maintained parallel to each other so that the mounting bracket 102 can move relative the gate 10 and ground 40 without tilting toward or away from either.

A motor 116 is mounted on the upper portion of the mounting bracket 102. The motor 116 has a motor shaft 118 on which is mounted a first pulley 120 for rotation therewith. The motor 116 is a reversible motor controlled through a switching relay 200.

Below the motor 116, a drive shaft 122 is mounted on the mounting bracket 102 for rotation about a generally horizontal axis. A second pulley 124 is mounted along the drive shaft 122 for rotation therewith and is aligned with the first pulley 120. A belt 126 is positioned about the groove in each pulley 120 and 124 to join the pulleys for common rotation. The motor 116 can be adjustably mounted to bracket 102 to tension belt 126. A drive wheel 128 is also mounted on the drive shaft 122 for rotation therewith which includes a plurality of gear teeth 130 distributed about the outer periphery thereof.

A ground wheel 132 is also rotatably mounted on the mounting bracket 102 for rotation about a generally horizontal axis. The outer periphery of the ground wheel 132, including gear teeth 134, contacts the ground 40. The gear teeth 134 also engage the gear teeth 130 on drive wheel 128 near the top of the ground wheel 132. A slot 133 permits the ground wheel 132 to be adjusted on mounting bracket 102 to properly mesh teeth 130 and 134.

FIG. 5 illustrates a modification wherein drive wheel 128 is replaced by a sprocket 202 having gear teeth 204. A chain 206 extends about sprocket 202, meshing with teeth 204, and about a sprocket 208 with teeth 210 mounted for rotation with ground wheel 132.

As can be understood from FIGS. 4 and 5 and the above description, the weight of the gate opener 100 is basically supported on the ground 40 through the ground wheel 132. The weight of the gate opener 100 provides sufficient frictional contact between the ground wheel 132 and the ground 40 so that the ground wheel 132 will be capable of opening and closing the gate, even if the ground is muddy or covered with ice or snow. In addition, the parallel arm hinge assembly 104 will permit the gate opener 100 to move and permit the ground wheel 132 to follow the terrain of the ground 40 if the ground is not flat.

Mounted on the gate 10 are an open limiter switch 136 and a closed limiter switch 138 as best seen in FIG. 6. The open limiter switch 136 cooperates with a contact 140 on shaft 212 mounted on the post 12. The closed limiter switch 138 cooperates with a contact 142 on shaft 212. Shaft 212 is preferably centered along the pivotal axis of gate 10. In the alternative, contacts 140 and 142 can be mounted directly on post 12. As can be seen in FIG. 6, the open limiter switch 136 will be activated by the contact 140 when the gate moves into the open position. The closed limiter switch 138 will be activated by a contact with the contact 142 when the gate moves into the closed position. Signal line 143 extends from the switches 136 and 138 to gate opener 100.

The operation of the gate opener 100 is substantially similar to that of gate 10. To open the gate, the controller 30 will be activated to transmit an electromagnetic signal to the receiver 32. The receiver 32 will activate the motor 116 which rotates first pulley 120, second pulley 124, drive shaft 122, drive wheel 128 and ground wheel 132 to open the gate. The motor 116 will remain activated to move the gate until the open limiter switch 136 is activated by the contact 140. When open limiter switch 136 is activated, the gate will be in the open position and the motor 116 will be deactivated through switching relay 200 to stop further movement of the gate.

An automatic timing mechanism can be employed to maintain the gate in the open position for a predetermined time before activating the gate opener 100 to return the gate to the closed position. Alternately, or in addition, the subsequent activation of the controller 30 to transmit an electromagnetic signal to the receiver 32 can be employed to activate the gate opener 100 to close the gate. In closing, the motor 116 rotates the motor shaft 118 in the opposite direction to rotate the first pulley 120, second pulley 124, drive shaft 122, drive wheel 128 and ground wheel 132 to close the gate. When the closed limiter switch 138 is activated by contact 142, the motor 116 is deactivated through switching relay 200 to stop movement of the gate.

The use of open limiter switch 136 and closed limiter switch 138 permits the motor 116 to operate continuously when the gate is between the open and closed positions. Therefore, if the ground wheel 132 slips relative to the ground 40, the motor 116 will continue rotating the ground wheel 132 until the gate has either reached the open or closed position. The contacts 140 and 142 are each adjustably mounted on the shaft 212 by adjustment screws 144 to permit variation of the open and closed position of the gate 10.

Although two embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A gate opener for use on a gate mounted to a structure for pivotal motion about a generally vertical axis, comprising:

a mounting bracket mounted on the gate for limited vertical motion;

motor means mounted on the mounting bracket for rotating a shaft;

conductor means for providing power to said motor means to rotate the shaft;

wheel means rotatably mounted on the mounting bracket and in contact with a stationary surface;

transmission means interconnecting the motor shaft and said wheel means for transmitting rotation of the shaft to said wheel means;

a receiver for activating said motor means in response to reception of an electromagnetic signal of predetermined frequency to selectively open and close the gate; and a portable controller for transmission of the electromagnetic signal at the predetermined frequency from a position remote from the gate, the frequency being proprietary to resist unauthorized operation of the gate, the controller permitting operation of the gate between the open and closed positions from within a vehicle proximate the gate, the mounting bracket, motor means, wheel means and transmission means having their weight supported at least in part through the wheel means on the stationary surface so that the weight of the mounting bracket, motor means, wheel means and transmission means assists in providing traction to the wheel means on the stationary surface sufficient to permit the gate to be pivoted about the vertical axis with the mounting bracket, motor means, wheel means and transmission means moving vertically sufficient to move over obstructions and to follow the grade of the stationary surface.

2. The gate opener of claim 1 wherein said transmission means includes first and second gears having teeth thereon interconnected for joint rotation by a chain to transmit rotation from the shaft of said motor means to said wheel means.

3. A gate opener for use on a gate mounted to a structure for pivotal motion about a generally vertical axis, comprising:

a frame mounted to the gate adjacent the ground and extending generally outward from the gate;

an electric motor mounted to said frame and having a generally horizontally disposed shaft;

a conductor extending from a power source to said electric motor for rotating the shaft;

a first pulley mounted for rotation on the shaft of said electric motor;

a second pulley rotatably mounted to said frame;

a belt extending about said first and second pulleys;

a tension pulley for tensioning said belt about said first and second pulleys for joint rotation thereof;

a first gear having a plurality of teeth formed about the outer periphery thereof mounted for rotation with said second pulley;

at least one drive wheel mounted on said frame through an axle for rotation, said drive wheel being in contact with the ground along a portion of its outer periphery;

at least one balance wheel mounted on said gate on the side of the gate opposite said drive wheel to counterbalance forces exerted on the gate by the drive wheel;

a second gear having a plurality of teeth formed about the outer periphery thereof mounted for rotation with said drive wheel;

a chain interconnecting said first and second gears for joint rotation thereof;

a receiver mounted adjacent the gate for receiving a proprietary electromagnetic signal at a predetermined frequency and activating said motor upon receiving the signal to rotate a predetermined number of revolutions to operate the gate between open and closed positions; and a portable controller for transmission of the proprietary electromagnetic signal at the predetermined frequency from a position remote from the gate, the proprietary signal resisting unauthorized operation of the gate, the controller permitting operation of the gate between open and closed positions from within a vehicle proximate the gate.

4. The gate opener of claim 3 wherein said axle is adjustable relative to the ground to provide sufficient frictional contact between said wheel and the ground so that rotation of said wheel and axle pivot the gate to the opened or closed position.

5. The gate opener of claim 3 wherein said first gear is mounted vertically about said second gear to minimize the projection of the first and second gears and chain from the gate.

6. The gate opener of claim 3 wherein said second pulley is mounted vertically above said first pulley to minimize the projection of said first and second pulleys and belt from the gate.

7. The gate opener of claim 3 further comprising lever means mounted to said frame for moving said tension pulley to detension said belt to permit manual opening and closing of the gate.

8. A gate opener for attachment to a pre-existing gate mounted to a structure for pivotal motion about a generally vertical axis, comprising:

an electric motor having a rotatable shaft;

a frame for pivotal attachment to the gate to support said electric motor therefrom with the shaft lying horizontal and extending along the length of the gate;

a first pulley mounted for rotation with the shaft of said electric motor;

a second pulley mounted for rotation on said frame vertically above said first pulley;

a belt constrained about both said first and second pulleys;

a tension pulley for tensioning said belt to cause joint rotation of said first and second pulleys;

a first gear having teeth formed on the outer periphery thereof mounted for rotation with said second pulley;

a drive wheel mounted on said frame through an axle for rotation, said axle being vertically adjustable on the gate to permit the drive wheel to contact the ground with sufficient force so that rotation of the drive wheel pivots the gate;

at least one balance wheel mounted on said gate on the side of the gate opposite said drive wheel to counterbalance forces exerted on the gate by the drive wheel;

a second gear having teeth formed on the outer periphery thereof mounted for rotation with said drive wheel;

a chain interconnecting said first and second gears for joint rotation thereof;

a receiver mounted adjacent said electric motor for receiving a proprietary electromagnetic signal at a predetermined frequency for activating a relay in a circuit connecting said electric motor to a power source to activate said electric motor for rotating the shaft to operate the gate between open and closed positions; and a portable controller for transmission of the proprietary electromagnetic signal at the predetermined frequency from a position remote from the gate, the proprietary signal resisting unauthorized operation of the gate, the controller permitting operation of the gate between open and closed positions from within a vehicle proximate the gate.

9. The gate opener of claim 8 wherein said axle is directly below said electric motor.

10. The gate opener of claim 8 further comprising a tension lever for moving said tension pulley to detension said belt to permit manual opening and closing of the gate.

11. A gate opener for use on a gate mounted to a structure for pivotal motion about a generally vertical axis, comprising:

a mounting bracket;

a parallel arm hinge assembly pivotally mounted to said mounting bracket and to the gate permitting pivotal motion of the mounting bracket relative to the gate and ground;

motor means mounted on said mounting bracket for rotating a shaft;

ground wheel means rotatably mounted on the mounting bracket and in contact with the ground;

transmission means interconnecting the motor shaft and said ground wheel means for transmitting rotation of the motor shaft to said ground wheel means, the weight of the mounting bracket, motor means, transmission means and ground wheel means generally being supported on the ground through the ground wheel means to provide traction for the ground wheel means, the parallel arm hinge assembly permitting movement of the gate opener relative to the gate so that the ground wheel means can maintain traction on the ground;

controller means for transmission of a signal at a predetermined frequency; and receiver means for activating said motor means in response to reception of the signal of predetermined frequency to selectively open and close the gate.

12. The gate opener of claim 11 wherein said gate opener further comprises an open limiter switch for sensing movement of the gate into the opened position and a closed limiter switch for sensing movement of the gate into the closed position, the open limiter switch acting to stop the motor means as the gate opener moves the gate into the opened position, said closed limiter switch acting to stop the motor means as the gate opener moves the gate into the closed position.

13. The gate opener of claim 11 wherein said parallel arm hinge assembly includes four arms, each pivotally connected at one end to said gate and at the opposite end to said mounting bracket, said arms being maintained in a parallel relationship.

14. The gate opener of claim 11 wherein said transmission means includes a first pulley mounted on said motor shaft, a drive shaft mounted on said mounting bracket for rotation about a generally horizontal axis, a second pulley mounted for rotation with said drive shaft and in alignment with said first pulley and a drive wheel mounted for rotation on said drive shaft having gear teeth about the outer periphery thereof, said ground wheel having gear teeth about the outer periphery thereof meshed with the gear teeth on said drive wheel and a belt constrained about said first and second pulleys for joint rotation thereof.

15. A gate opener for use on a gate mounted to a structure for pivotal motion about a generally vertical axis, comprising:

motor means mounted on the gate for rotating a shaft;

ground wheel means rotatably mounted on the gate and in contact with a stationary surface;

transmission means interconnecting the motor shaft and said ground wheel means for transmitting rotation of the shaft to said ground wheel means;

controller means for transmission of a signal at a predetermined frequency;

receiver means for activating said motor means in response to reception of the signal of predetermined frequency to selectively open and close the gate; and an open limiter switch means for sensing movement of the gate into the opened position for deactivating said motor means when the gate is moved into the opened position by the gate opener and closed limiter switch means for sensing movement of the gate into the closed position for deactivating the motor means when the gate opener moves the gate into the closed position, the use of the open and closed limiter switches permitting control of the gate opener independent of slippage between the ground wheel means and the stationary surface to allow a gate opener using a ground wheel means to be used in environments where slippage can occur.

16. A gate opener for use on a gate mounted to a structure for pivotal motion about a generally vertical axis, comprising:

a mounting bracket;

a parallel arm hinge assembly pivotally mounting said mounting bracket to the gate, said parallel arm hinge assembly including at least two parallel arms each pivotally connected to the gate at one end and the mounting bracket at the opposite end for pivotal motion about generally horizontal axes;

motor means mounted on said mounting bracket for rotating a motor shaft;

a first pulley secure along said motor shaft for rotation with said motor shaft;

a drive shaft rotatably mounted on said mounting bracket for rotation about a generally horizontal axis;

a second pulley secured along said drive shaft for rotation with said drive shaft and aligned with said first pulley for placement of a belt about said first and second pulleys for joint rotation thereof;

a drive wheel mounted on said drive shaft for rotation therewith having gear teeth formed on the outer periphery thereof;

a ground wheel mounted for rotation on said mounting bracket, the parallel arm hinge assembly causing the ground wheel to contact the ground with substantially the entire weight of the gate opener being supported by the ground through the ground wheel, said ground wheel having gear teeth formed thereon meshed with the gear teeth on said drive wheel so that rotation of the motor shaft rotates the ground wheel;

controller means for transmission of a signal at a predetermined frequency;

receiver means for activating said motor means in response to reception of the signal of predetermined frequency to selectively open and close the gate;

an open limiter switch for sensing movement of the gate to the opened position for deactivating the motor means as the gate opener moves the gate into the closed position; and a closed limiter switch for sensing movement of the gate to the closed position for deactivating the motor means as the gate opener moves the gate into the closed position.

* * * * *